US011118771B2

(12) United States Patent
Carpintero et al.

(10) Patent No.: US 11,118,771 B2
(45) Date of Patent: Sep. 14, 2021

(54) FLAMELESS CANDLE WITH MULTI-PURPOSE FLAME ELEMENT

(71) Applicant: STERNO HOME INC., Vancouver (CA)

(72) Inventors: Carlos Carpintero, Delson (CA); Victor Dario Sena Rivero, Longueuil (CA)

(73) Assignee: STERNO HOME INC., Vancouver (CA)

( * ) Notice: Subject to any disclaimer, the term of this patent is extended or adjusted under 35 U.S.C. 154(b) by 0 days.

(21) Appl. No.: 17/018,412

(22) Filed: Sep. 11, 2020

(65) Prior Publication Data

US 2021/0080092 A1 Mar. 18, 2021

Related U.S. Application Data

(60) Provisional application No. 62/902,203, filed on Sep. 18, 2019.

(51) Int. Cl.

| | |
|---|---|
| ***F21V 23/04*** | (2006.01) |
| ***F21S 9/02*** | (2006.01) |
| ***H01R 35/04*** | (2006.01) |
| ***F21S 10/04*** | (2006.01) |
| *F21Y 115/10* | (2016.01) |

(52) U.S. Cl.

CPC ..... *F21V 23/04* (2013.01); *F21S 9/02* (2013.01); *F21S 10/04* (2013.01); *H01R 35/04* (2013.01); *F21Y 2115/10* (2016.08)

(58) Field of Classification Search

CPC .. F21V 23/04; H01R 35/04; F21S 9/02; F21S 10/04; F21Y 2115/10

See application file for complete search history.

(56) References Cited

U.S. PATENT DOCUMENTS

| | | | | |
|---|---|---|---|---|
| 8,282,251 | B2 * | 10/2012 | Fournier | F21S 6/001 362/392 |
| 9,371,972 | B2 | 6/2016 | Li | |
| 9,551,470 | B2 * | 1/2017 | Li | F21S 6/001 |
| 9,739,432 | B2 | 8/2017 | Li | |
| 2008/0129226 | A1 * | 6/2008 | DeWitt | H05B 47/155 315/307 |
| 2008/0151563 | A1 * | 6/2008 | Chen | F21V 23/0442 362/392 |
| 2014/0218903 | A1 * | 8/2014 | Sheng | F21S 10/046 362/190 |

FOREIGN PATENT DOCUMENTS

| | | | | |
|---|---|---|---|---|
| DE | 4040136 | A1 * | 6/1991 | F21V 23/0442 |

* cited by examiner

*Primary Examiner* — Elmito Breval

(74) *Attorney, Agent, or Firm* — McAndrews, Held & Malloy, Ltd.

(57) ABSTRACT

A flameless candle may include a candle body configured to house a power source, a light source configured to selectively receive power from the power source; and a flame element. The flame element may include an interior surface and an exterior surface. The flame element may be configured to receive light emitted from the light source at the interior surface and to pass through at least a portion of the light to the exterior surface. The flame element may be configured to move with respect to the candle body to act as an actuator to selectively activate at least one function of the flameless candle.

12 Claims, 10 Drawing Sheets

FLAMELESS CANDLE WITH MULTI-PURPOSE FLAME ELEMENT

CROSS REFERENCE TO RELATED APPLICATIONS

The present application claims the benefit of U.S. Prov. Appl. No. 62/902,203, the entirety of which is incorporated by reference herein.

BACKGROUND

Generally, this application relates to flameless candles, and particularly, to a flameless candle with a movable flame element that serves as an actuator to cause at least one function.

Conventional flameless candles may include many forms, such as tea lights, votive candles, pillar candles, and taper candles. Such flameless candles may have an exposed flame element extending from an upper surface. The flame element may emulate the flame of a conventional flamed candle.

SUMMARY

According to certain embodiments, a flameless candle may include: a candle body that houses a power source; a light source that selectively receives power from the power source; and a flame element including an interior surface and an exterior surface, wherein the flame element that receives light emitted from the light source at the interior surface and passes through at least a portion of the light to the exterior surface, wherein the flame element moves with respect to the candle body to act as an actuator to selectively activate at least one function of the flameless candle (for example, illuminating the light source). The candle body may include an outer shell and a base, wherein the outer shell may include an aperture configured to receive the flame element.

The flame element may move in a horizontal (e.g., rotational) or vertical dimension. The flame element may rotate between a first position and a second position with respect to the candle body. At least a portion of the light source (e.g., a lead of an LED package) may rotate with the flame element such that, when in the first position, the light source receives a current from the power source and when in the second position, the light source does not receive the current from the power source. The light source may include a light-emitting diode package including a first lead and a second lead. The first lead may be constantly electrically connected to a first terminal of the power source, and the second lead may be electrically connected (e.g., directly contacting) to a second terminal of the power source only when the flame element is in the first position. The flame element may include an arm extending radially and configured to receive the second lead, such that the second lead rotates with the flame element. The second lead may be configured to contact a lateral surface of the power source when the second lead is in the first position. The second lead may alternatively be configured to contact a top surface of the power source when the second lead is in the first position. The flame element may include a downwardly-extending portion extending downwardly from the arm, wherein the downwardly-extending portion may be configured to apply inward pressure to the second lead when the flame element is in the first position. The second lead may include a first portion extending radially away from a body of the light source and a second portion extending downwardly away from the first portion, and the second portion of the second lead may contact the lateral surface of the power source when the second lead is in the first position.

The flameless candle is may provide auditory and/or tactile feedback when the flame element is moved into at least one of the first position or the second position. The base may include at least one detent configured to receive a portion of the flame element to provide the tactile feedback. The at least one detent may include a first detent configured to receive a portion of the flame element in the first position and a second detent configured to receive a portion of the flame element in the second position. The first detent and second detent may face inwardly or upwardly. The power source may have a center axis along a Z-dimension extending upwardly from a center of the power source, and a casing of the light source may have a center axis along a Z-dimension extending upwardly from a center of the casing of the light source, such that the center axis of the power source is offset from the center axis of the casing of the light source.

Figure 1:
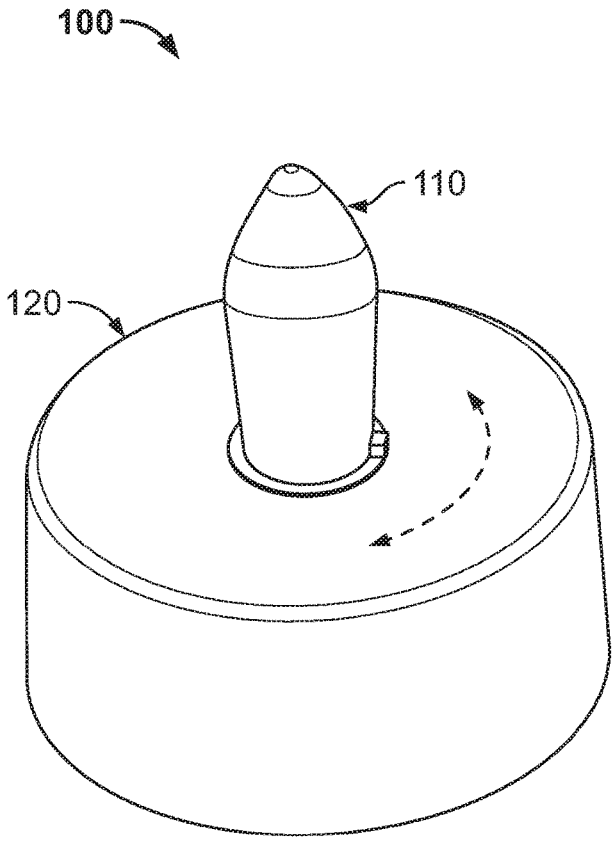
FIG. 1 illustrates a perspective view of a flameless candle according to certain techniques of this application.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

Virtually all flameless candles include some type of actuator that allows a user to turn the light source ON or OFF. Other types of functionality may also be activated/deactivated using such actuators. Often, these types actuators are located on the bottom of the candle, so as to preserve the illusion of a real candle. Yet the bottom of the candle is not immediately accessible to a user. With such candles, it may be necessary for the user to pick the candle up and/or turn it sideways or upside-down to access the actuator. Besides physical switches (including slide switches, push buttons, etc.), other types of actuators may enable a user to enable functionality in candles. Such other actuators may include capacitive touch sensors, microphone sensors, motion sensors, other types of remote sensing sensors, or the like. While these types of sensors may allow a user to activate and/or deactivate functionality without first physically turning the candle, they may add unwanted cost and/or complexity.

Instead, of these solutions, certain techniques disclosed herein allow for a user to activate and/or deactivate functionality of a candle without first moving the candle sideways or upside-down. In particular, certain candles have protruding flame elements. Certain techniques disclosed herein may enable a user to move the flame element with respect to at least a portion of the candle body to selectively activate candle functionality, such as energizing and/or de-energizing the light source(s). For example, certain techniques disclosed herein may provide for a design in which the flame element can be rotated (e.g., clockwise and counterclockwise) with respect to the candle body to turn the candle's light source ON and OFF.

Figure 2:
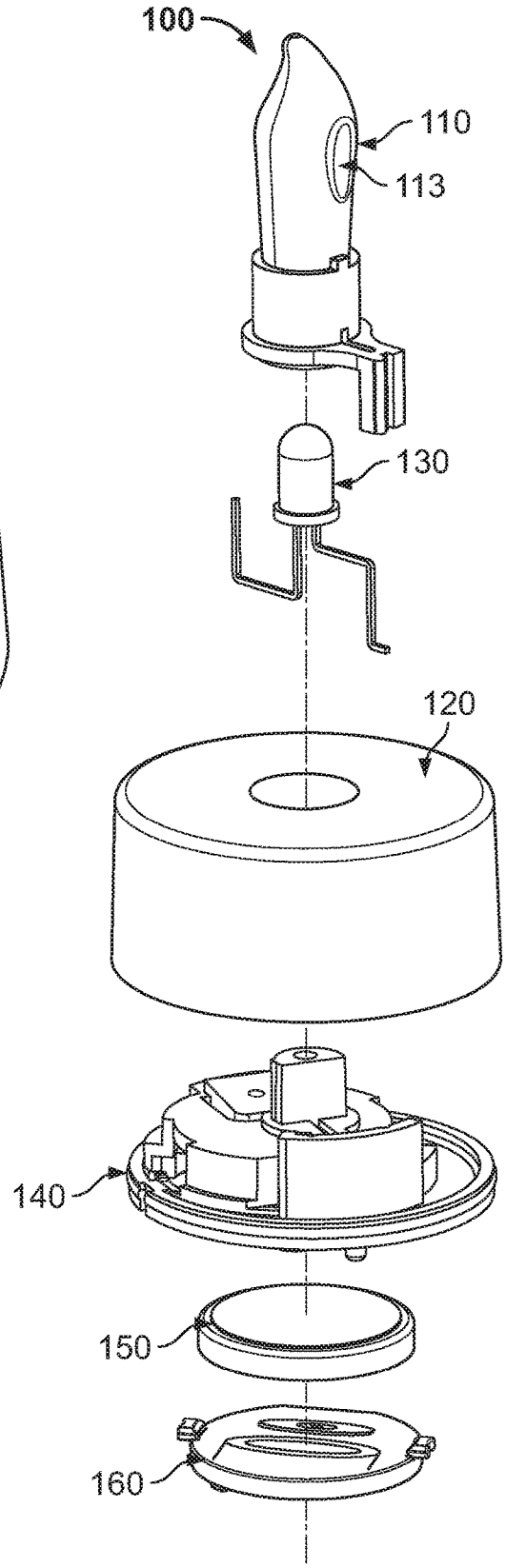
FIG. 2 illustrates an exploded view of a flameless candle according to certain techniques of this application.
Figure 3:
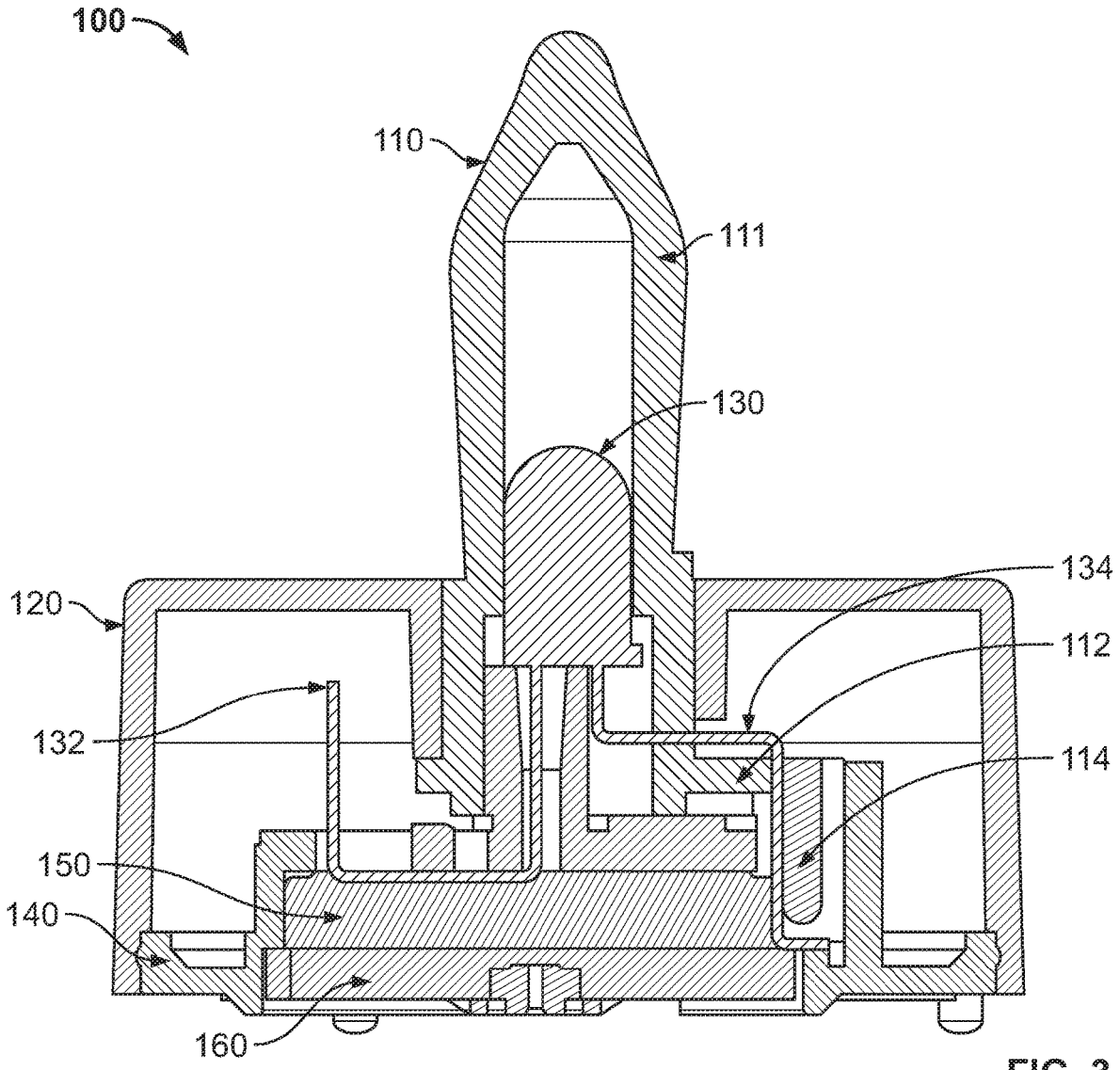
FIG. 3 illustrates a cross-sectional view of a flameless candle according to certain techniques of this application.

As depicted in FIGS. 1-3, a candle 100 may include a shell 120, a flame element 110, a light source 130, a base 140, a power source 150, and a power source door 160. A candle body may be formed at least in part by the shell 120, the base 140, and/or the power source door 160. The candle body may house the power source 150 (e.g., one or more batteries, such as a button battery like a CR2032). The power source door 160 may be located in a lower region of the candle 100. The power source door 160 may be removable to access the power source and remove or insert it into a compartment within the candle 100.

Figure 4:
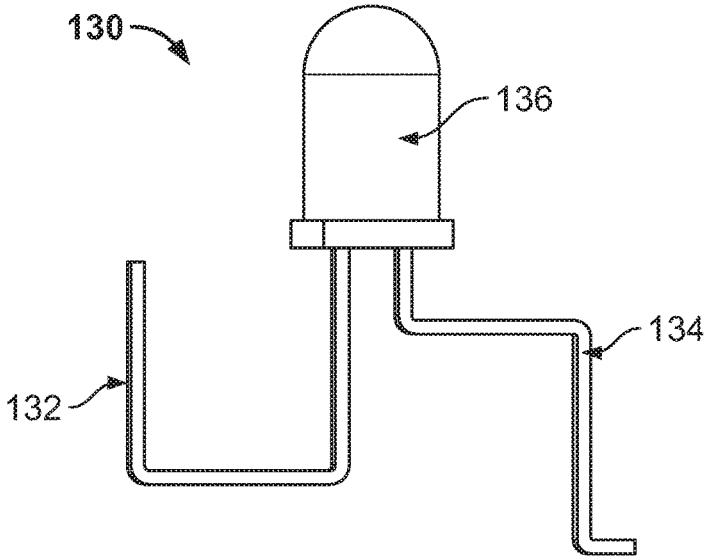
FIG. 4 illustrates an LED package according to certain techniques of this application.

As shown in FIG. 4, the light source 130 may include an LED package, further including a case 136 housing at least one light-emitting diode(s), a first lead 132 connected to the anode(s) of the light-emitting diode(s), and a second lead 134 connected to the cathode(s) of the light-emitting diode(s). The LED package 130 may include circuitry to control the light-emitting diode(s). The circuitry may be encapsulated inside the case 136 or located elsewhere. The circuitry may include one or more processors. The circuitry may modulate power provided to light-emitting diode(s) to cause dimming or a flickering effect (e.g., to emulate the appearance of a true flame). The circuitry may also enable a timer (e.g., 24-hour timer), enable changing colors of the light-emitting diode(s), or the like. The light source 130 may receive power from the power source 160.

As depicted in FIGS. 1-3, a flame element 110 may be shaped to resemble a candle flame. The flame element 110 may extend upwardly through an aperture in the upper surface of the shell 120, such that the shell 120 receives the flame element 110. The flame element 110 may be capable of rotating relatively freely within the aperture of the shell 120, as further discussed herein. The flame element 110 may include an interior surface and an exterior surface. The flame element 110 may receive light emitted from the light source 130 at the interior surface and to pass through at least a portion of the light to the exterior surface. The flame element 110 may rotate clockwise and counterclockwise with respect to the upper surface of the shell 120 and/or the base 140 into a first position and a second position, respectively or vice versa. For example, the shell 120 and the base 140 may maintain a constant positional relationship, while the flame element 120 may rotate with respect to the base 140 and shell 120. Alternatively, the shell 120 may rotate with the flame element 110 with respect to the base 140, which does not rotate relative to the flame element 110 and the shell 120.

When the flame element 110 is in the first position, the function of the candle (e.g., illuminating the light source 130) may be activated (i.e., ON). When the flame element 110 is in the second position, the function may be deactivated (i.e., OFF). In such a fashion, the flame element 110 may act as an actuator to selectively activate at least one function of the candle 100. In addition to energizing and de-energizing the light source 150, other functions may be possible, such as activating a timer (e.g., a 24-hour timer), changing color of the light source 130, causing the light source 130 to flicker, causing/enabling the candle 100 to emit a sound, or the like. The flame element 110 may also move in a vertical dimension to activate or deactivate the function. An example of such a vertically-moving flame element 110 is discussed with regard to FIGS. 12A, 12B, 13A, and 13B. Such a flame element 110 may both rotate in a horizontal dimension and move in a vertical dimension at the same time.

Figure 5:
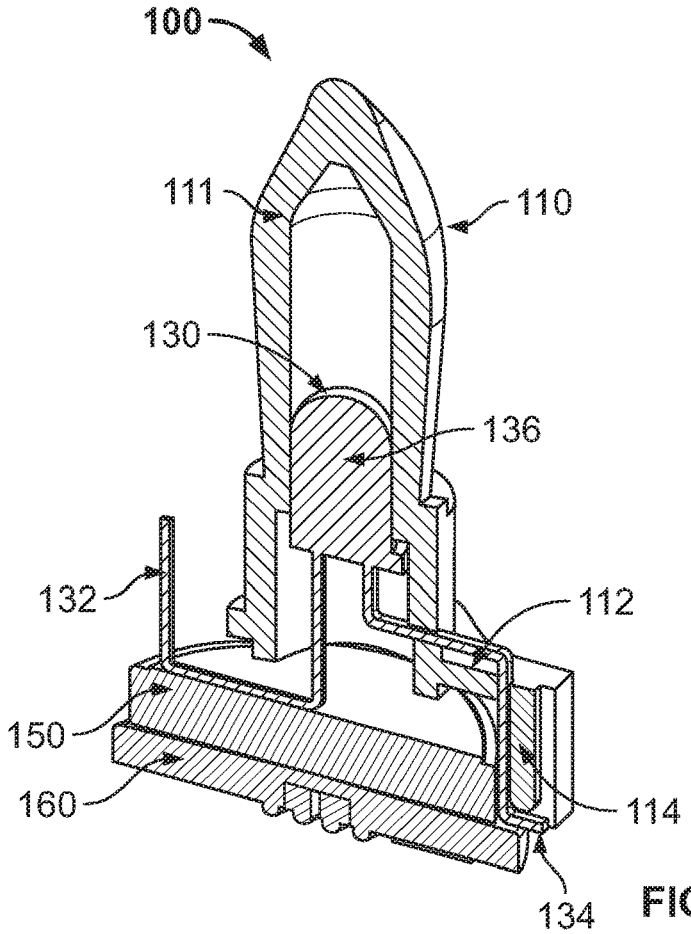
FIG. 5 illustrates a cross-sectional view of a portion of a flameless candle according to certain techniques of this application.

A portion of the light source 130 (e.g., at least a portion of the case 136) may fit inside an inner cavity of the flame element 110. Further, the first and/or second lead 132, 134 of the light source 130 may pass through one or more apertures of the flame element 110. As shown in FIG. 5, the second lead 134 passes through an aperture (horizontally oriented) in the flame element 110 from the interior to the exterior, and then passes through another aperture (vertically oriented) where it makes intermittent contact with a lateral surface of the power source 150, depending on the rotational position of the flame element 110. The first lead 132 may constantly contact an upper surface of the power source 150 (when the power source 150 is installed). The portion of the first lead 132 that continuously contacts the upper surface of the power source 150 may not move, irrespective of the position of the flame element 110. Alternatively, the portion of the first lead 132 that continuously contacts the upper surface of the power source 150 may rotate with the flame element 110.

Figure 6:
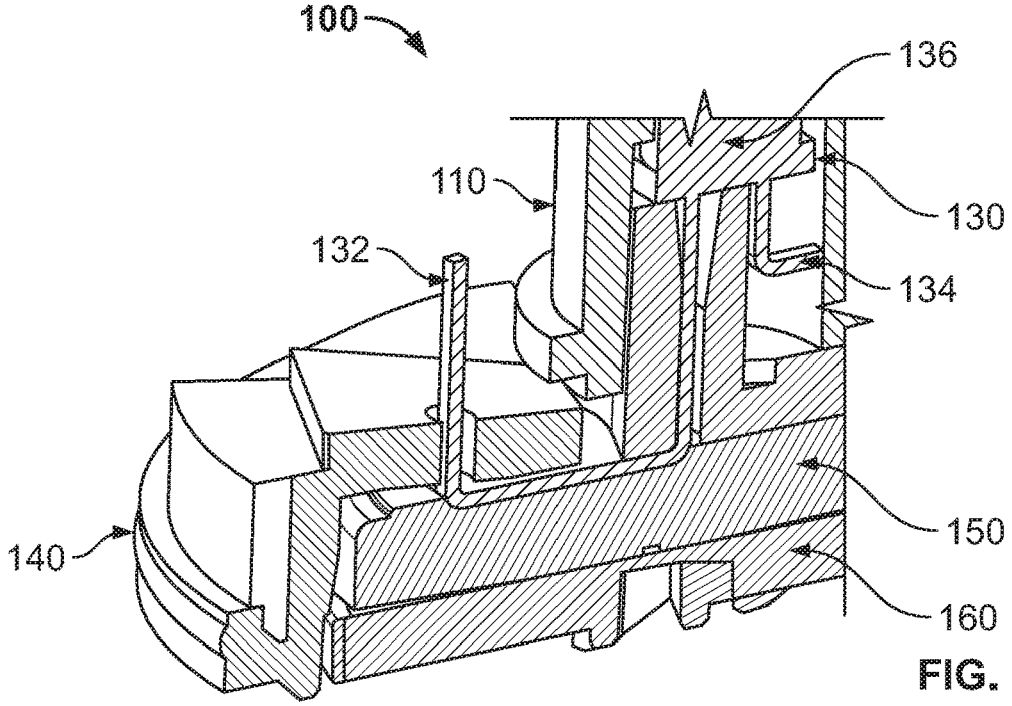
FIG. 6 illustrates a cross-sectional view of a portion of a flameless candle according to certain techniques of this application.
Figure 8:
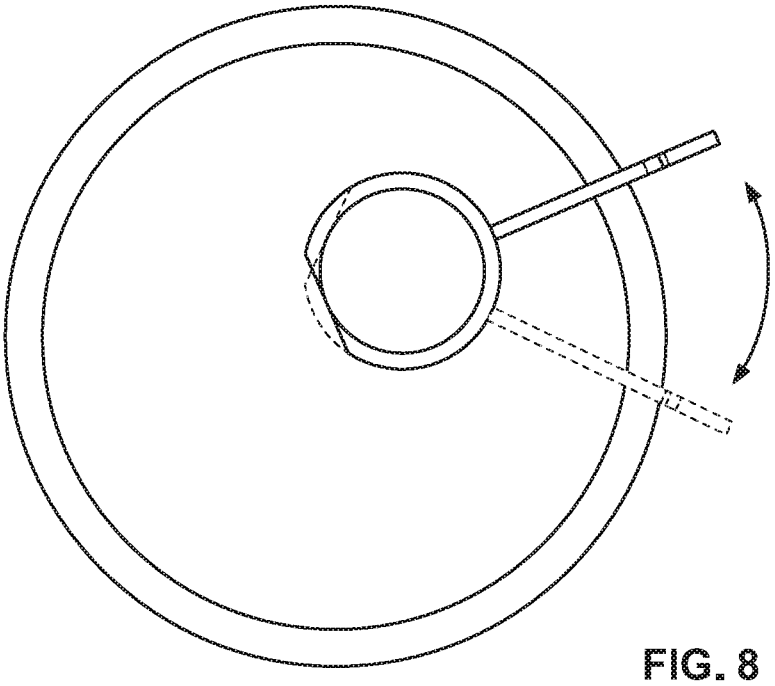
FIG. 8 illustrates a top view of a portion of a flameless candle according to certain techniques of this application.

As shown in FIG. 8, the second lead 134 may move depending on the position of the flame element 110, thereby creating intermittent contact with the lateral surface of the power source 150 (e.g., negative terminal). As shown in FIG. 6, the light source lead 132 may be secured (substantially) in place via one or more apertures in the base 140. The base 140 (and power source 150) may not move when the flame element 110 moves. The light source lead 132 may be formed in a "U" shape as shown, such that the horizontal section of the "U" may constantly contact the upper surface of the power source 150 (e.g., positive terminal).

Figure 9:
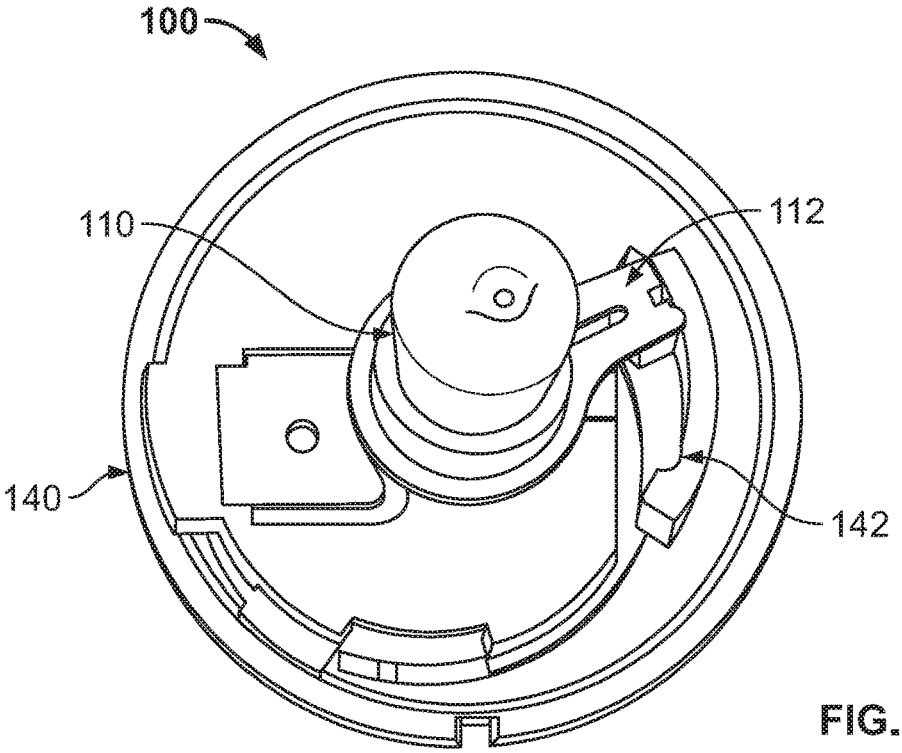
FIG. 9 illustrates a top perspective view of a portion of a flameless candle according to certain techniques of this application.
Figure 10A:
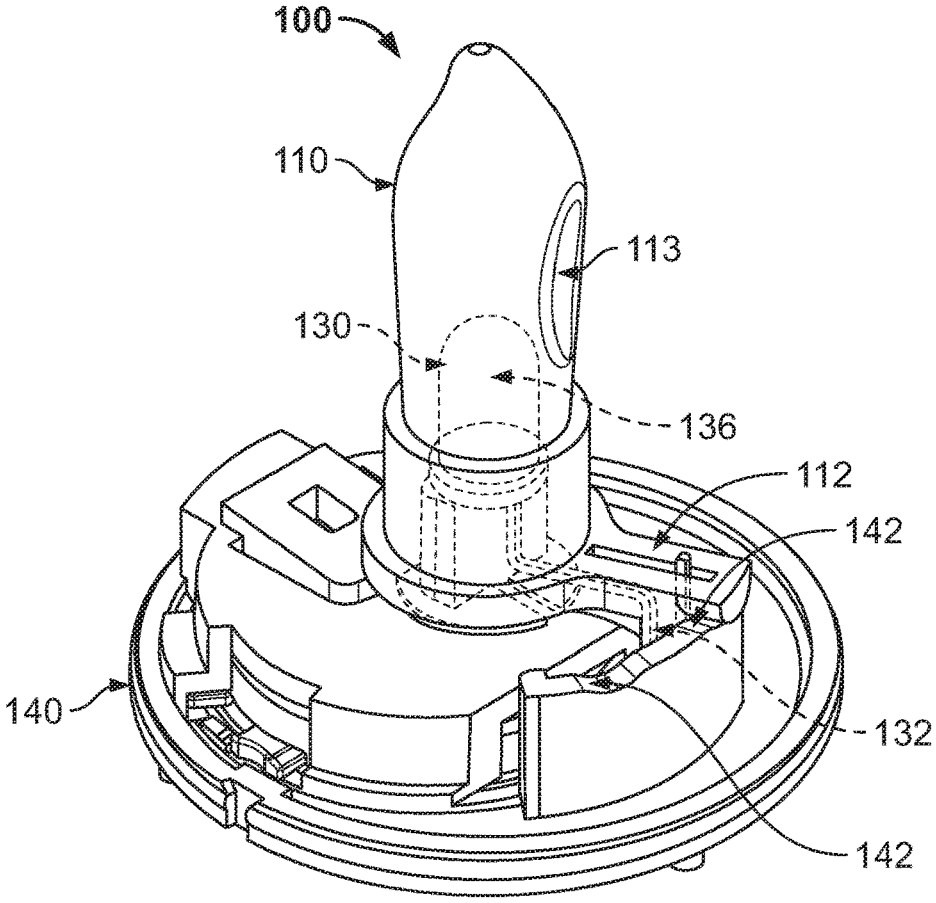
FIG. 10A illustrates a perspective view of a portion of a flameless candle according to certain techniques of this application.
Figure 10B:
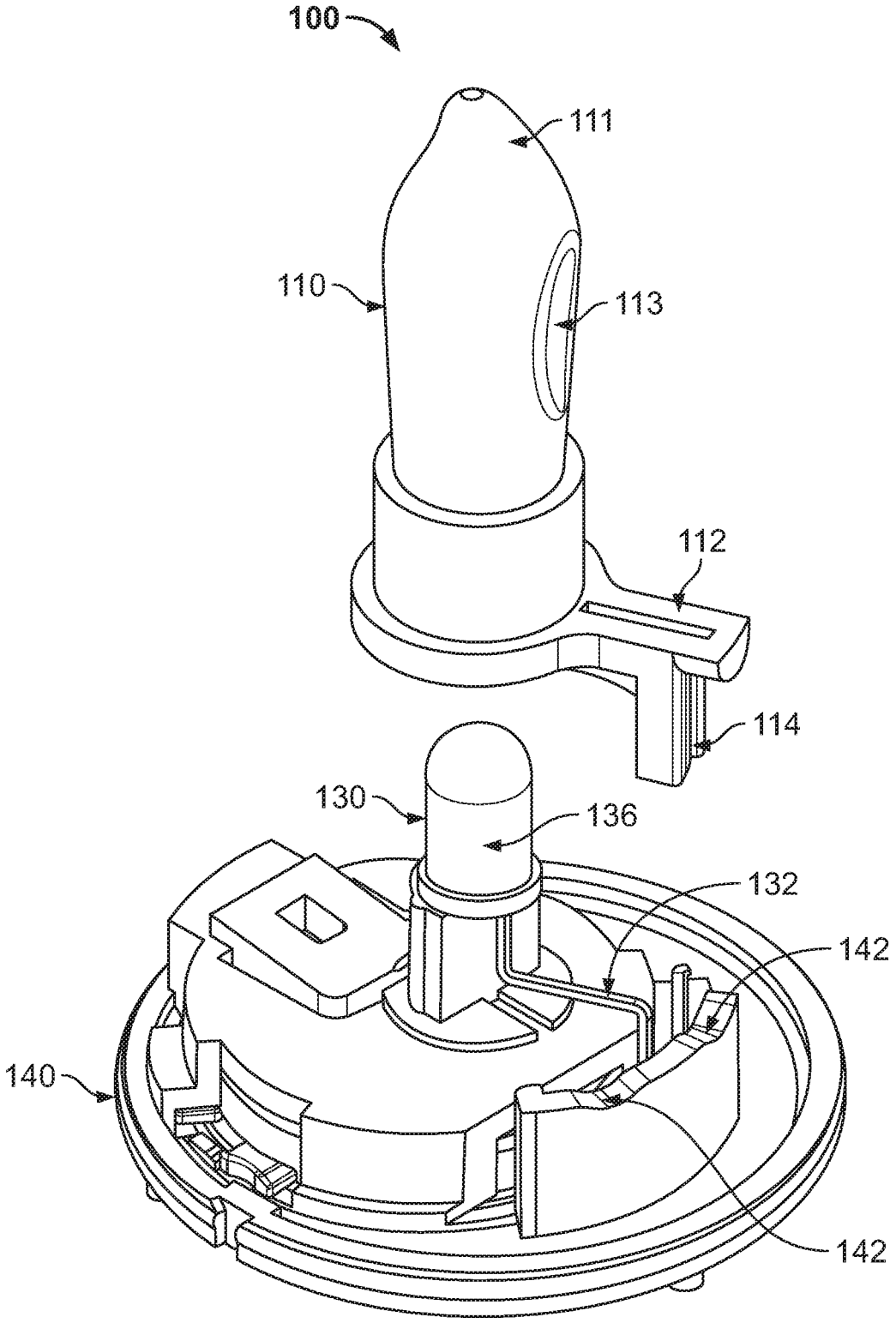
FIG. 10B illustrates a partially exploded view of a portion of a flameless candle according to certain techniques of this application.
Figure 11:
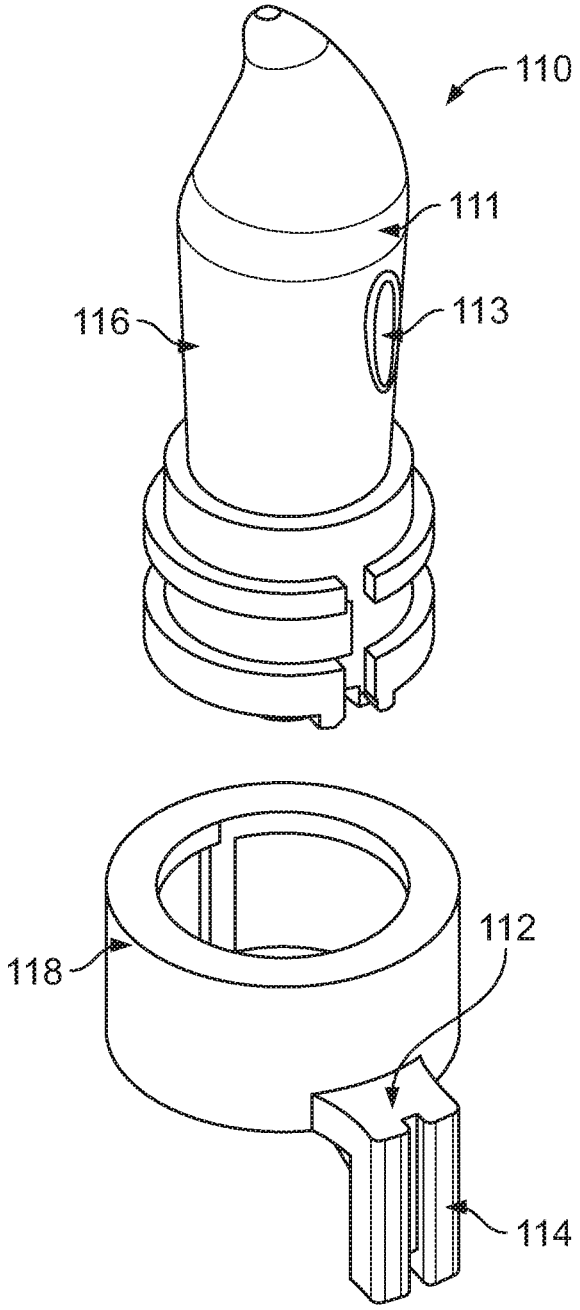
FIG. 11 illustrates a perspective view of a flame element according to certain techniques of this application.

As shown in FIGS. 3, 5, 9, 10A, 10B, 11, 12A, 12B, 13A, and 13B, the flame element 110 may include a flame-shaped portion 111, one or more indentations 113, an arm 112, and a downwardly-extending portion 114. The flame-shaped portion 111 may protrude through the upper surface of the shell 120 through an aperture. The flame-shaped portion 111 may include one or more indentations 113. Such indentations 113 may receive a portion of a user's finger so as to facilitate grabbing and rotating the flame element 110. The arm 112 may extend laterally from a portion of the flame element 110 below the upper surface of the shell 120. The downwardly-extending portion 114 may extend downwardly from the arm 112. As shown in FIG. 11, the flame component 110 may be separable into two portions 116 and 118. These portions may be connected together by a friction fit, a rotational fit where one component rotates to join with the other component, or the like. The arm 112 and/or the downwardly-extending portion 114 may guide the second lead 134 of the light source 130 into a position where it can make selective contact with a lateral surface of the power source 150. For example, it may guide the second lead 134 laterally out from the case 136 and then downwardly towards the lateral surface of the power source 150.

Figure 7:
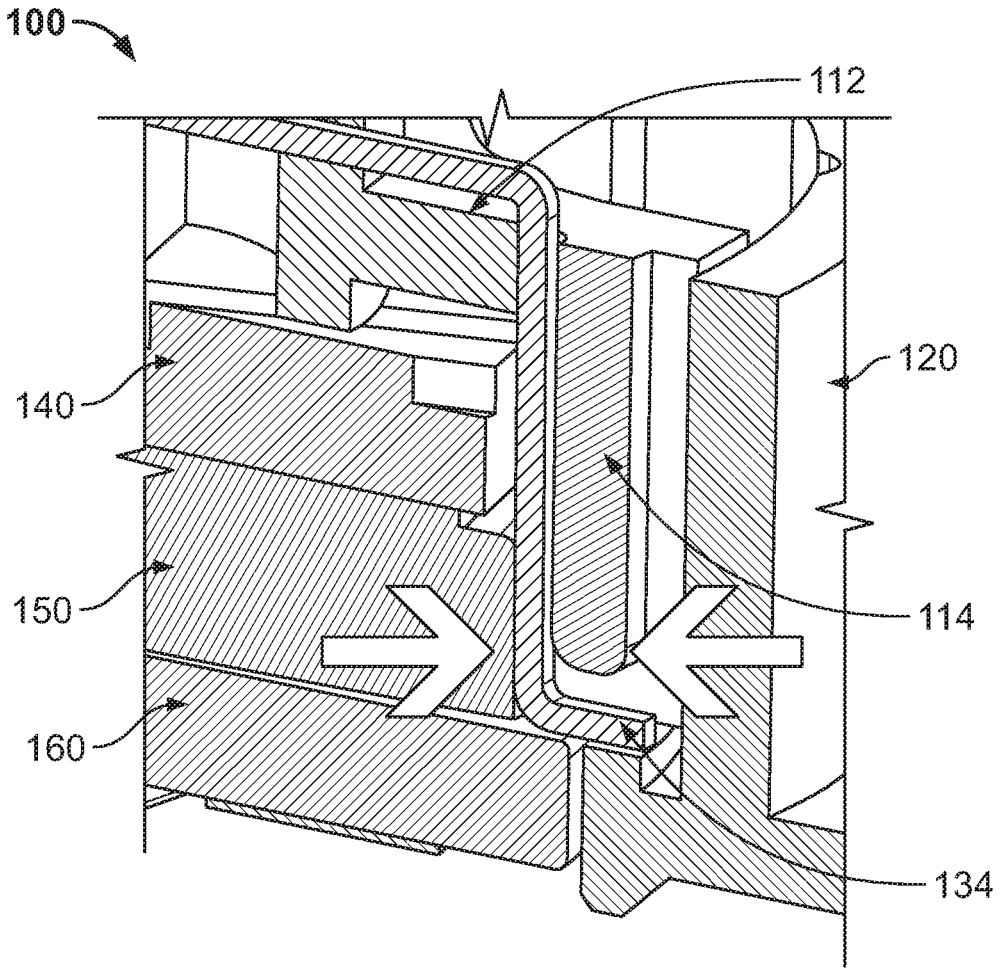
FIG. 7 illustrates a cross-sectional view of a portion of a flameless candle according to certain techniques of this application.

When the flame element 110 is in the ON position, the second lead 134 may contact a lateral surface of the power source 150. As shown in FIG. 7 by the arrows, an inner surface located on the downwardly-extending portion 114 of the flame element 110 may push the second lead 134 into a lateral surface of the power source 150, thus maintaining a consistent contact between the second lead 134 and the power source 150 when the flame element 110 is in the ON position. When the flame element 110 is in the OFF position, the second lead 134 may be separated from the lateral surface of the power source 150.

As shown in FIG. 8, the center of the light source 130 may be offset from the center of the power source 150. For example, the position of the power source 150 may be offset from the center of the candle shell 120 to achieve the effect illustrated in FIG. 8. The base 140 may maintain the power source 150 in an offset position. So for example, the case 136 of the light source 130 may be positioned substantially in the center of the flameless candle 100 and then encapsulated by the flame element 110 also substantially in the center. This may give the appearance of a conventional candle, such as a tea light. The power source 150 below, however, may be offset, such that the center of the power source 150 does not precisely align with the center of the case 136. For example, the power source 150 may have a center axis along a Z-dimension extending upwardly from a center of the power source 150, and wherein the casing 136 of the light source 130 has a center axis along a Z-dimension extending upwardly from a center of the casing 136. These axes may be offset. In such an arrangement, for example, the space between the portion of the lead 134 that contacts the lateral surface of the power source 150 and the power source 150 itself may vary depending on the rotational angle of the second lead 134.

When the first lead 132 contacts the upper surface of the power source 150 (first terminal, e.g. positive or anode) and the second lead 134 contacts the lateral surface of the power source 150 (second terminal, e.g., negative or cathode), then current will flow through and energize the light source 130 (and associated circuitry), and the candle 100 will operate. When the lateral surface of the power source 150 does not contact the second lead 134, then current will not flow and the LED is de-energized.

As shown in FIGS. 9, 10A, and 10B, the base 140 may facilitate stabilizing the position of the flame element 110 when in the ON or OFF position. The base 140 may include at least one detent 142 for the ON position and at least one detent 142 for the OFF position. The flame element 110 may include a corresponding at least one protrusion on the arm 112 that mates with the detents 142. The flame element arm 112 and/or base 140 may act as a spring allowing the flame element 110 to snap into and out of the detents 142. The action of snapping into and out of the detents 142 may cause tactile and/or sound feedback so a user knows the candle 100 is in the ON position or OFF position. The candle 100 (e.g., the base 140) may include one or more stops to prevent over-rotating the flame element 110 beyond the ON and OFF positions.

The detent(s) 142 may be arranged vertically such that they face inwardly (FIG. 9), or horizontally (FIGS. 10A and 10B) such that they face upwardly. When the detent(s) 142 are arranged vertically, the corresponding protrusion(s) on the arm 112 may protrude outwardly in a radial direction away from the flame element. When the detent(s) 142 are arranged horizontally, the corresponding protrusion(s) on the arm 112 may protrude downwardly towards the base 140.

Figure 12A:
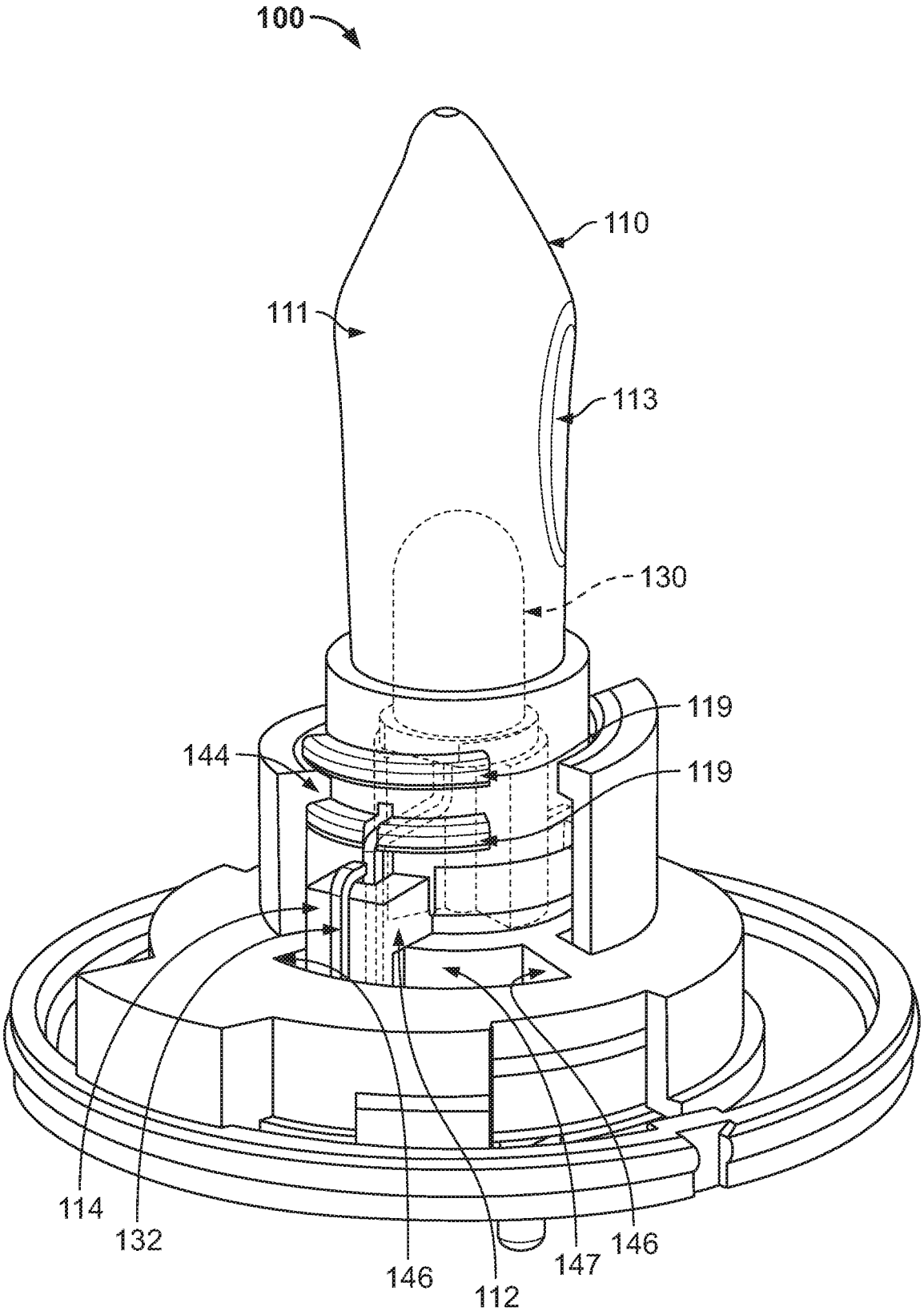
FIG. 12A illustrates a perspective view of a portion of a flameless candle according to certain techniques of this application.
Figure 12B:
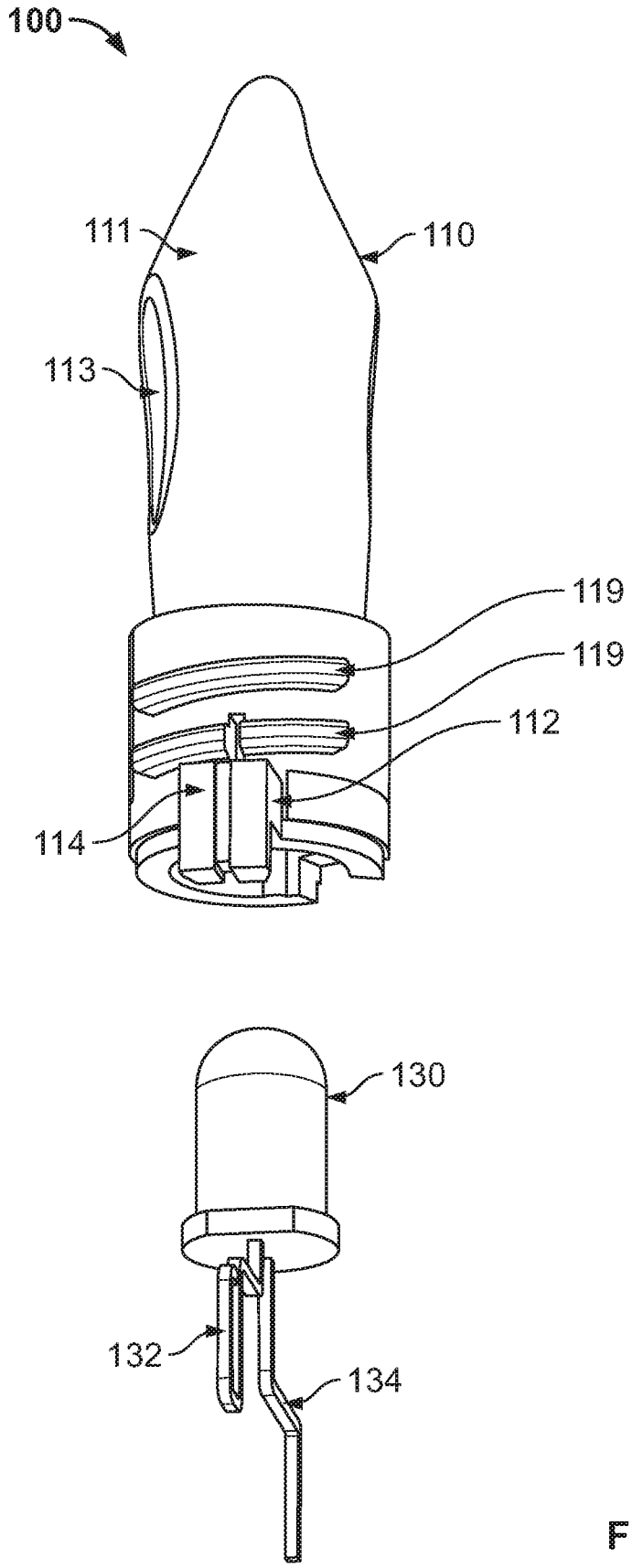
FIG. 12B illustrates an exploded view of a flame element and an LED package according to certain techniques of this application.
Figure 13A:
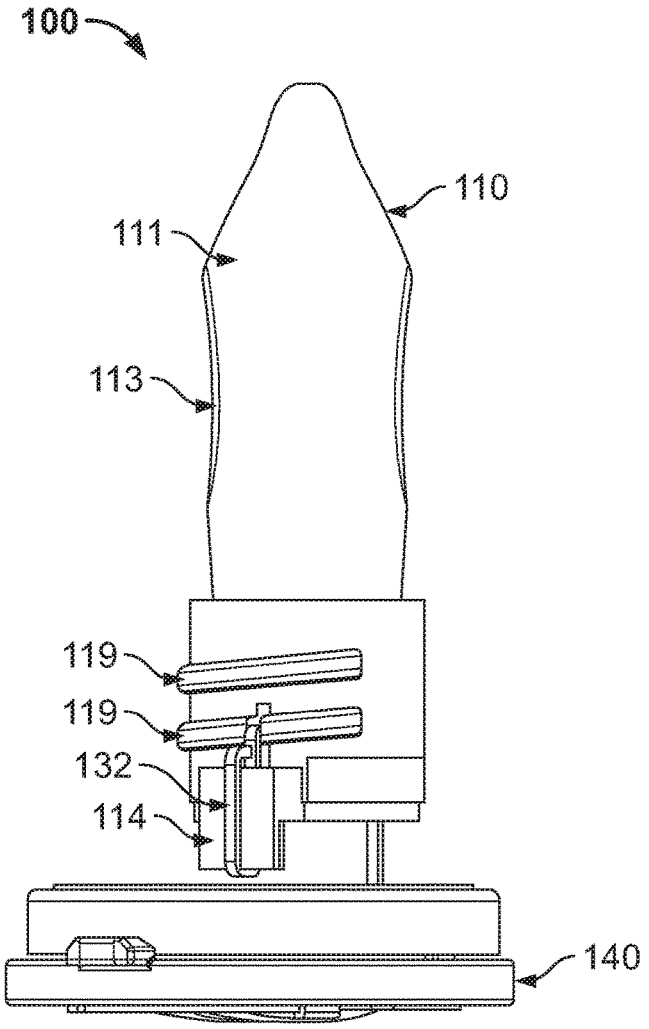
FIG. 13A illustrates an elevational view of a portion of a flameless candle according to certain techniques of this application.
Figure 13B:
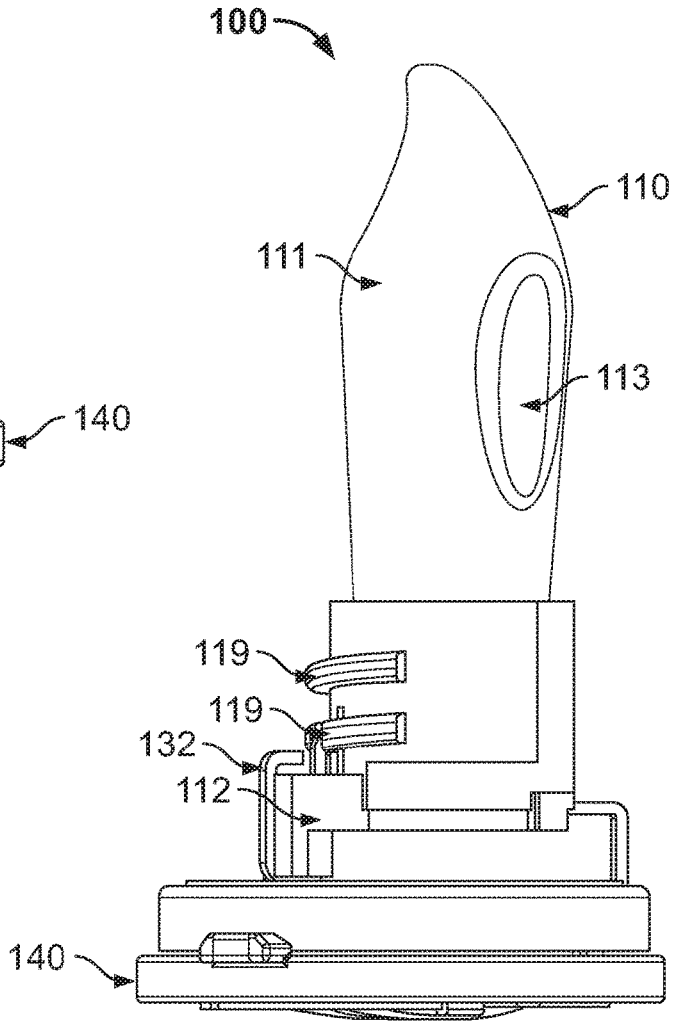
FIG. 13B illustrates an elevational view of a portion of a flameless candle according to certain techniques of this application.

FIGS. 12A, 12B, 13A, and 13B illustrate a candle 100 with a flame element 110 that moves not only in a horizontal and rotational dimension, but also moves in a vertical dimension according to certain techniques of the present application. Instead of the second lead 134 being selectively connected and disconnected from a lateral side of the power source 150 as shown in FIGS. 1-11, the second lead 134 is constantly connected to the lateral side of the power source 150. Also, instead of the first lead 132 being constantly connected to a top side of the power source 150, the first lead 132 is selectively disconnected and connected from the top side of the power source 150, as shown in FIGS. 13A (disconnected) and 13B (connected).

The second lead 134 may include bends such that the second lead extends downwardly from the casing 136, outwardly towards the edge of the power source 150, and downwardly again to provide a surface of the lead 134 that can touch a lateral side of the power source 150. In order to maintain consistent and constant contact between the second lead 134 and the lateral side of the power source 150, an arrangement such as that shown in FIG. 7 may be used, whereby a downwardly extending portion of the flame element 110 pushes against the second lead 134 against the lateral side of the power source 150 (not shown). Alternatively, the base 140 may be arranged to apply inward pressure to the second lead 134 (not shown).

According the techniques shown in FIGS. 12A, 12B, 13A, and 13B, the first lead 132 is arranged in such a fashion so that a portion of the first lead 132 is arranged horizontally. The horizontal portion may be located on a lower end of the first lead 132. The horizontal portion of the first lead 132 may move up and down with the flame element 110. When the flame element 110 moves downwardly, the first lead 132 (e.g., a lower, horizontal portion thereof) may contact an upper surface of the power source 150 (see, e.g., FIG. 13B). When the flame element 110 moves upwardly, the first lead may then be disconnected from the upper surface of the power source 150 (see, e.g., FIG. 13A).

Vertical movement of the flame component 110 may be facilitated by ridge(s) 119 on the flame component 110. The ridges 119 may form a grove there between. Optionally, instead of ridges 119, a groove may be formed by a recess in the surface of the flame element 110 (not shown). The groove may be diagonally oriented with an upward/downward slope. The groove may accept an inwardly-protruding portion 144 of the base 140. The inwardly-protruding portion 144 in combination with the groove in the flame element 110 may constrain and control movement of the flame component in the vertical dimension when the flame element 110 is in the ON or OFF positions. The groove may be arranged in such a manner that the lower end of the groove (shown on the left side of the groove of the flame element 110 in FIG. 12B) sets the height of the flame component 110 in such a way that the first lead 132 may contact the upper surface of the power source 150. The groove may further be arranged such that the upper end of the groove (shown on the right side of the groove of the flame element 110 in FIG. 12B) may set the height of the flame component 110 such that the first lead 132 is above and not contacting the upper surface of the power source 150. In this manner, as the flame component 110 rotates in a first direction (e.g., counter-clockwise as depicted), it may rise up to disconnect the first lead 132 from the upper surface of the power source 150. When the flame component 110 rotates in a second direction (e.g., clockwise as depicted), it may go down to connect the first lead 132 to the upper surface of the power source 150.

The casing 136 of the light source 130 may be located within the flame element 110. The flame element 110 may include an aperture on its sidewall such that the first lead 132 may pass through this aperture and extend outside of the flame element 110. The first lead 132 may be wrapped at least partially around the arm 112 and/or the downwardly-extending portion 114. The arm 112 and/or downwardly-extending portion 114 may include a groove that accepts the first lead 132 and maintains the position of the first lead 132 with respect to the rest of the flame component 110. When the flame component 110 is in the ON position, a lower region of the downwardly extending portion 114 may exert pressure against the first lead 132 to maintain contact between the first lead 132 and the upper surface of the power source 150.

Rotation of the flame element 110 depicted in FIGS. 12A, 12B, 13A, and 13B may be constrained in a rotational dimension, for example, as shown in FIGS. 9, 10A, and 10B. Using such techniques, detent(s) in the base 140 and a corresponding protrusion in the arm 112 may be used to cause the flame element 110 to snap into the ON and/or OFF positions.

A different technique of constraining the rotation of the flame element 110 is shown in FIG. 12A. This technique may be also be used with the candle 100 arrangements shown in FIGS. 1-11. According to this technique, the base 140 may have an aperture 147 that accommodates the downwardly-extending portion 114 of the flame element 110. The aperture 147 extends along a rotational dimension. Portions of the base 146 may act as stops to prevent the flame element 110 from over-rotating beyond the ON and/or OFF positions of the flame element 110. Detent(s) and corresponding protrusion(s) (not shown) may be provided in a suitable position to enable the flame element 110 to snap in and out of the ON and/or OFF positions.

The candle 100 may include other switches or the flame element 110 may be movable into three or more positions to activate additional functions, such as sound, color, flickering effect, other lighting effects, timer (e.g., 24-hour timer), or the like. Such switches may be located on the bottom of the candle.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A flameless candle comprising:

a candle body configured to house a power source having a top surface and a lateral surface;

a light source including a light-emitting diode (LED), a first conductor connected to the LED, and a second conductor connected to the LED, wherein the first conductor is configured to be constantly electrically connected to the top surface of the power source, and wherein the second conductor is configured to selectively contact the lateral surface of the power source, such that the light source is configured to selectively receive a current from the power source; and a flame element including an interior surface and an exterior surface, wherein the flame element is configured to receive light emitted from the light source at the interior surface and to pass through at least a portion of the light to the exterior surface, wherein the flame element is configured to move between a first position and a second position with respect to the candle body to act as an actuator to selectively illuminate the LED by causing movement of the second conductor, such that the second conductor is configured to contact the lateral surface of the power source when the flame element is in the first position, and the second conductor is configured to be separated from the lateral surface of the power source when the flame element is in the second position, wherein when the flame element is in the first position, the second conductor is electrically connected to the power source, such that the LED receives current, and wherein when the flame element is in the second position, the second conductor is not electrically connected to the power source, such that the LED does not receive current.

2. The flameless candle of claim 1, wherein the candle body comprises an outer shell and a base, wherein the outer shell includes an aperture configured to receive the flame element.

3. The flameless candle of claim 2, wherein the flame element is configured to rotate between the first position and the second position with respect to the candle body.

4. The flameless candle of claim 3, wherein the flameless candle is configured to provide tactile feedback when the flame element is moved into at least one of the first position or the second position.

5. The flameless candle of claim 4, wherein the base further comprises at least one detent configured to receive a portion of the flame element to provide the tactile feedback.

6. The flameless candle of claim 5, wherein the at least one detent comprises a first detent configured to receive a portion of the flame element in the first position and a second detent configured to receive a portion of the flame element in the second position.

7. The flameless candle of claim 3, wherein the power source comprises a center axis along a Z-dimension extending upwardly from a center of the power source, and wherein a casing of the light source comprises a center axis along a Z-dimension extending upwardly from a center of the casing of the light source, wherein the center axis of the power source is offset from the center axis of the casing of the light source.

8. The flameless candle of claim 1, wherein the the first conductor comprises a first lead and the second conductor comprises a second lead, wherein the first lead is configured to be constantly electrically connected to the top surface of the power source, and the second lead is configured to contact the lateral surface of the power source only when the flame element is in the first position.

9. The flameless candle of claim 8, wherein the flame element comprises an arm extending radially and configured to receive the second lead, such that the second lead rotates with the flame element.

10. The flameless candle of claim 9, wherein the flame element comprises a downwardly-extending portion extending downwardly from the arm, wherein the downwardly-extending portion is configured to apply inward pressure to the second lead when the flame element is in the first position.

11. The flameless candle of claim 9, wherein the second lead comprises a first portion extending radially away from a body of the light source and a second portion extending downwardly away from the first portion, wherein the second portion of the second lead is configured to contact the lateral surface of the power source when the flame element is in the first position.

12. A flameless candle comprising:

a candle body configured to house a power source having a top surface and a lateral surface;

a light source including a light-emitting diode (LED), a first conductor connected to the LED, and a second conductor connected to the LED, wherein the first conductor is configured to be constantly electrically connected to the top surface of the power source, and wherein the second conductor is configured to selectively contact the lateral surface of the power source, such that the light source is configured to selectively receive a current from the power source; and a flame element configured to receive light emitted from the LED, wherein the flame element is configured to rotate between a first position and a second position with respect to the candle body to act as an actuator to selectively illuminate the LED by causing movement of the second conductor, such that the second conductor is configured to contact the lateral surface of the power source when the flame element is in the first position, and the second conductor is configured to be separated from the lateral surface of the power source when the flame element is in the second position.

* * * * *